US007605542B2

(12) United States Patent
Karasawa et al.

(10) Patent No.: US 7,605,542 B2
(45) **Date of Patent: *Oct. 20, 2009**

(54) LIGHT-EMITTING DEVICE

(75) Inventors: Hideo Karasawa, Nagano-ken (JP); Yoshiaki Matsumoto, Nagano-ken (JP); Masahiro Onuki, Nagano-ken (JP); Masayasu Sakuma, Nagano-ken (JP); Yutaka Takada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 205 days.

This patent is subject to a terminal disclaimer.

(21) Appl. No.: 11/536,407

(22) Filed: Sep. 28, 2006

(65) Prior Publication Data

US 2007/0069607 A1 Mar. 29, 2007

(30) Foreign Application Priority Data

Sep. 28, 2005 (JP) ..... 2005-282112

(51) Int. Cl.
*H01J 25/00* (2006.01)

(52) U.S. Cl. ..... 315/39.3; 315/39.51; 315/39.53; 315/39.57; 315/39.61; 315/39.63

(58) Field of Classification Search ..... 315/39, 315/111.01, 111.21, 111.41, 111.71, 111.91
See application file for complete search history.

(56) References Cited

U.S. PATENT DOCUMENTS

| | | | | |
|---|---|---|---|---|
| 4,056,760 | A * | 11/1977 | Frenk | 318/115 |
| 5,420,390 | A * | 5/1995 | Abe | 219/121.36 |
| 2005/0151525 | A1* | 7/2005 | Komori et al. | 323/282 |
| 2006/0081624 | A1* | 4/2006 | Takada et al. | 219/716 |
| 2007/0068909 | A1* | 3/2007 | Karasawa et al. | 219/121.43 |

FOREIGN PATENT DOCUMENTS

| | | |
|---|---|---|
| JP | A 9-265914 | 10/1997 |
| JP | A 2004-265611 | 9/2004 |

* cited by examiner

*Primary Examiner*—Douglas W Owens
*Assistant Examiner*—Jianzi Chen
(74) *Attorney, Agent, or Firm*—Oliff & Berridge, PLC

(57) ABSTRACT

A light-emitting device, includes: an emitter sealed with a gas emitting light caused by a microwave; a high frequency power supply section including a diamond SAW oscillator and outputting a high frequency signal being output from the diamond SAW oscillator to a subsequent stage; and a waveguide unit emitting the high frequency signal being input from the high frequency power supply section towards the emitter as the microwave.

7 Claims, 7 Drawing Sheets

LIGHT-EMITTING DEVICE

BACKGROUND OF THE INVENTION

1. Technical Field

The present invention relates to a light-emitting device, and more particularly, to a light-emitting device, which illuminates a gas with microwaves.

2. Related Art

An Industry Science Medical band (ISM band) using microwaves is applied to various devices such as light-emitting devices, heating devices, plasma generators, communication devices and radar units. In one of these devices, a magnetron is used as an oscillation source to generate microwaves.

JP-A-H9-265914 discloses a magnetron device provided with a high-voltage noise filter. In the disclosure, an insulating layer and a conductive layer on a surface of a coil-shaped conductive wire are provided, and high withstand voltage layers between an outer peripheral surface of the insulating layer and the conductive layer are provided in a vicinity region of the opposing ends of the conductive layer. This structure relaxes concentration of an electric field and improves withstand voltage characteristics of the insulating layer. Further, the structure reduces a thickness of the insulating layer, obtaining a small-sized and low-cost high-voltage noise filter.

Further, JP-A-2004-265611 discloses a plasma processing apparatus. This disclosure indicates that a high-frequency generating source used in the plasma processing apparatus is provided with a magnetron and the like.

As a magnetron is large in size, it was unable to reduce the size and weight of the microwave generator using this. Therefore, when the microwave generator is used for a light-emitting device, it was unable to reduce the size and weight of the light-emitting device. Also, there were problems with the magnetron that it requires a large amount of power, has bad frequency-temperature characteristics, output frequency is unstable and the like.

Further, FIG. 9 is a diagram showing a relationship between the frequency and intensity of signals being output from a magnetron. In FIG. 9, a lateral axis shows frequency and a longitudinal axis shows intensity. A magnetron to generate a microwave of which the certain frequency is $f_2$, also outputs microwaves having frequencies around the frequency $f_2$. For example, when 2.45 GHz is necessary as the certain frequency $f_2$, the magnetron also outputs microwaves having other frequencies around 2.45 GHz since the magnetron outputs frequency signals having a bandwidth. Therefore, there was a problem of harming other devices using the ISM band, because of unwanted radiation generating from the magnetron.

Furthermore, in the microwave generator, not only the magnetron, but an LC oscillator and a dielectric oscillator can also be used as an oscillation source, and frequency signals being output from the oscillation source may also be used by converting into high frequency signals by a PLL (phase-locked loop) circuit and a multiplier circuit. However, the LC oscillator and the dielectric oscillator had problems such as having poor frequency-temperature characteristics, output frequency is unstable and frequency varies with respect to each oscillator. Also, the PLL circuit and the multiplier circuit had problems such as unable to miniaturize as a scale of the circuit is too large, require a large amount of power consumption, and take a long time to output the necessary frequency. And the PLL circuit has a problem that it cannot output the necessary frequency if unlocking occurs.

SUMMARY

The advantage of the present invention is to provide a light-emitting device that emits light by microwaves without unwanted radiation, and reduced in size and weight.

The light-emitting device according to an aspect of the present invention is provided with an emitter sealed in with a gas that emits light by microwaves, a diamond SAW oscillator, a high-frequency power supply section that outputs high frequency signals being output from the diamond SAW oscillator to a subsequent stage, and a waveguide unit that emits the high frequency signals being input from the high frequency power supply section towards the emitter as the microwaves.

This enables the light-emitting device to emit light from the emitter. Further, as the high frequency power supply section can be reduced in size and weight, the emitter can also be reduced in size and weight. Furthermore, as the diamond SAW oscillator oscillates a certain frequency directly, problems such as the emitter not emitting light due to different frequencies and harming other devices do not occur. Therefore, the light-emitting device can emit light in a stable manner. Also, as the diamond SAW oscillator activates in a short period of time, even if light is being output intermittently from the emitter by operating the light-emitting device intermittently, the light looks as though it is emitting continuously depending on a usage mode. Therefore, the light-emitting device can be reduced in power consumption. In addition, as the diamond SAW oscillator has good frequency stability, low phase noise, and no unwanted radiation, occurrence of flicker in the light being output from the light-emitting device can be prevented.

The emitter may be provided with an introduction portion of the microwaves and an optical output section which outputs light emission of the gas. This structure is capable of introducing microwaves to the introduction portion and emits light by excitation of the gas and the like, and outputs light at least from the optical output section.

The optical output section is provided with a lens. The lens can collect light being output from the emitter.

Further, the high frequency power supply section may be provided with the diamond SAW oscillator that outputs the high frequency signals, a first amplifier that amplifies and outputs the high frequency signals being input from the diamond SAW oscillator, and a power supply that supplies power to the diamond SAW oscillator and the first amplifier. By providing the first amplifier to a subsequent stage of the diamond SAW oscillator, the high frequency signals being output from the diamond SAW oscillator can be amplified and output high in power.

Furthermore, the high frequency power supply section may be provided with the diamond SAW oscillator that outputs the high frequency signals, a plurality of first amplifiers connected in parallel with the diamond SAW oscillator and input the high frequency signals from the diamond SAW oscillator, respectively, the power supply that supplies power to the diamond SAW oscillator and the first amplifier, and an adder which is connected to a subsequent stage of the first amplifier, inputs and adds the high frequency signals being output from each of the first amplifier and outputs the added high frequency signals.

By providing the plurality of first amplifiers to the subsequent stage of the diamond SAW oscillator, the high frequency signals being output from the diamond SAW oscillator can be amplified. And as the high frequency signals being output from each of the first amplifier are added, the high frequency signals being output from the high frequency power supply section can be higher in power.

Also, the diamond SAW oscillator is formed in a loop circuit provided with a phase-shift circuit that inputs power from the power supply, a diamond SAW resonator which is arranged with at least an inter digital transducer on a substrate with diamond, a second amplifier that amplifies the high frequency signals being output from the diamond SAW resonator and a power divider that distributes the high frequency signals being output from the second amplifier to the phase-shift circuit and an output side.

The diamond SAW resonator has good frequency-temperature characteristics as it is using the substrate with diamond. This enables to improve the frequency-temperature characteristics and the frequency stability of the light-emitting device using the diamond SAW resonator. Further, as the diamond SAW resonator is manufactured using a microfabrication technique, it can be reduced in size and weight. This enables the light-emitting device using the diamond SAW resonator to be reduced in size and weight. Furthermore, as the diamond resonator is manufactured using the microfabrication technique, there will be no variation of resonance frequency with respect to each resonator. Also, the diamond SAW resonator excites a SAW to a substrate as soon as it inputs signals from the phase-shift circuit, and outputs the high frequency signals corresponding to the frequency of the SAW. Therefore, as it can output high frequency signals as soon as power is supplied from the high frequency power supply section provided with the diamond SAW oscillator, the light emitting device can shorten the time between the activation and the output of light.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
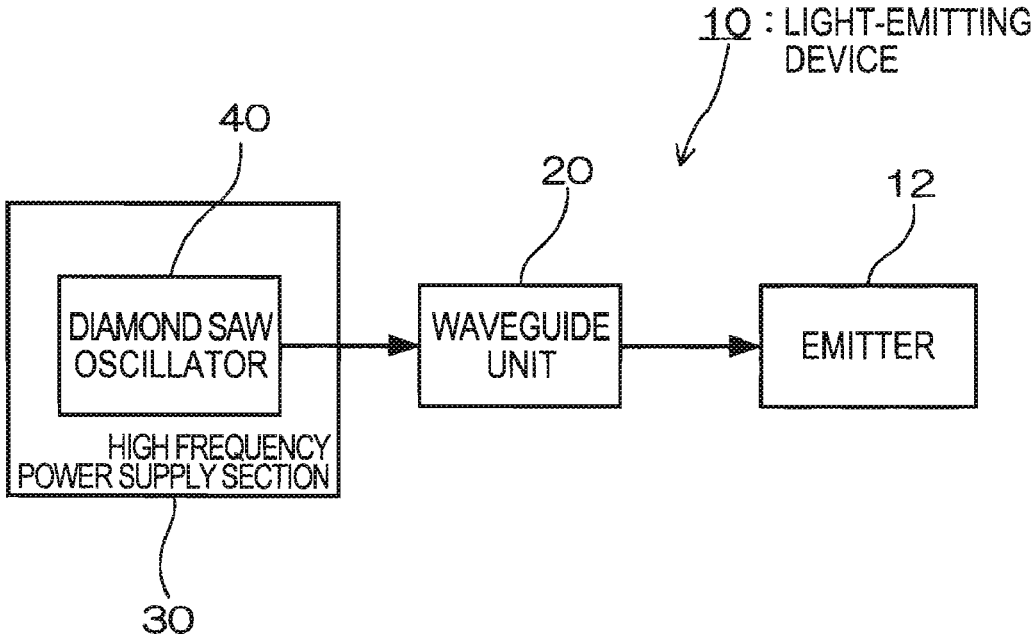
FIG. 1 is a block diagram showing a light-emitting device.

Embodiments of a light-emitting device according to the present invention will now be described below. To begin with, a first embodiment will be described. FIG. 1 is a block diagram showing a light-emitting device. A light-emitting device 10 has an emitter 12 sealed in with a gas that emits light by microwaves. Further, the light-emitting device 10 has a high frequency power supply section 30 provided with a diamond SAW (surface acoustic wave) oscillator 40. The high frequency power supply section 30 outputs high frequency signals obtained at the diamond SAW oscillator 40 to a subsequent stage. Furthermore, the light-emitting device 10 is connecting a waveguide unit 20 to a subsequent stage of the high frequency power supply section 30. The waveguide unit 20 emits the high frequency signals being input from the high frequency power supply section 30 towards the emitter 12 as microwaves. And the waveguide unit 20 may be an antenna 22, or have a structure provided with the antenna 22 and an isolator 24 (see FIG. 2B). By providing the isolator 24 between the high frequency power supply section 30 and the antenna 22, reflected waves generated at the antenna 22 can be prevented from returning to the high frequency power supply section 30.

Figure 2A:
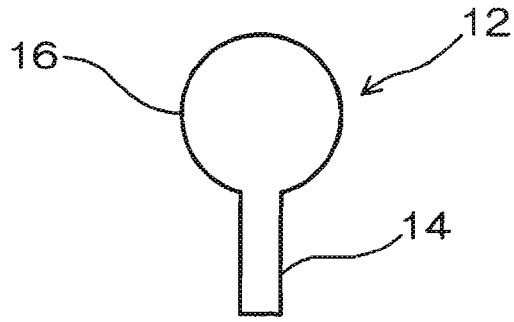
FIGS. 2A through 2C are explanatory diagrams showing an emitter.
Figure 2B:
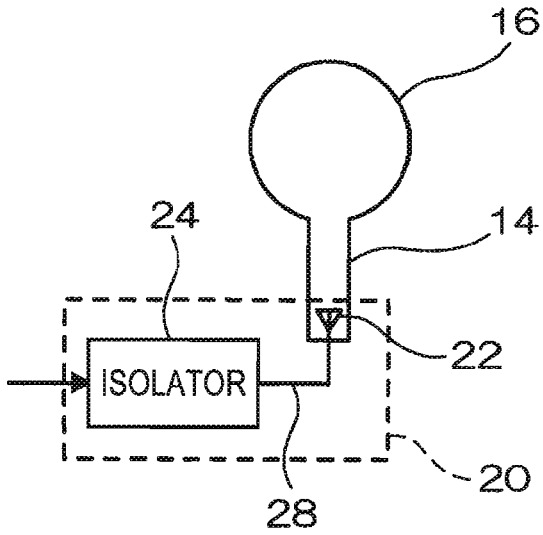
Figure 2C:
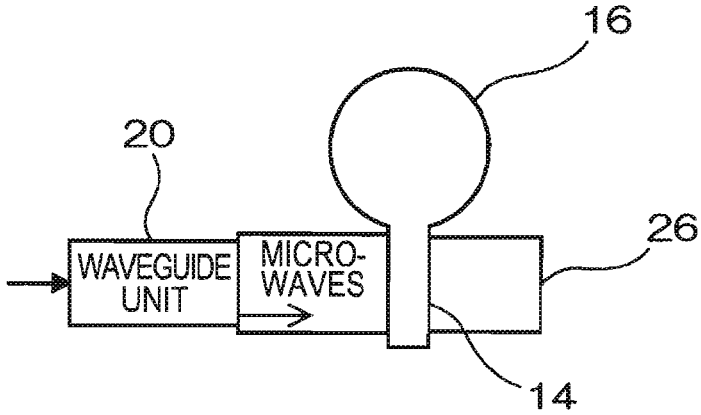

A concrete description of the emitter 12 will be given below. FIGS. 2A through 2C are explanatory diagrams showing an emitter. The emitter 12, as shown in FIG. 2A, is provided with an introduction portion 14 of microwaves in a tubular shape and an optical output section 16 in a spherical shape which outputs light emission of a gas excited and the like by microwaves to outside, and formed of a material that transmits light such as glass. The gas which is to be sealed in the emitter 12 may be a rare gas, for example, such as neon, argon, krypton and xenon. Further, the emitter 12 may be sealed in with metal and metal compound such as mercury and sodium, together with these gases. The emitter 12 may be arranged with a means to prevent microwave leakage (not shown), for example, such as a metal mesh.

Microwaves are introduced to the emitter 12, as shown in examples of FIGS. 2B and 2C. That is, in a case shown in FIG. 2B, it has a structure that the antenna 22 of the waveguide unit 20 is arranged in the introduction portion 14 of the emitter 12, as well as the isolator 24 is arranged outside of the emitter 12, and these two are connected by a signal line 28. Further, in a case that the metal mesh and the like is to be arranged to the emitter 12, it may be arranged to the entire emitter 12. And by emitting microwaves within the emitter 12 from the antenna 22, light emits by excitation of the gas and the like in the emitter 12, and outputs the light outside of the emitter 12.

Also, as in a case shown in FIG. 2C, a waveguide tube 26 is connected to the waveguide unit 20, and the introduction portion 14 of the emitter 12 is inserted into the waveguide tube 26. Further, in a case that the metal mesh and the like is to be arranged to the emitter 12, it may be arranged to a portion of the emitter 12 exposed from the waveguide tube 26. And by emitting microwaves in the waveguide tube 26 from the waveguide unit 20, the microwaves are irradiated to the introduction portion 14 of the emitter 12. Then, as the gas in the emitter 12 emits light by excitation and the like by the microwaves, the light outputs from the portion exposed from the waveguide tube 26, in other words, from the optical output section 16 to outside of the emitter 12.

Figure 3:
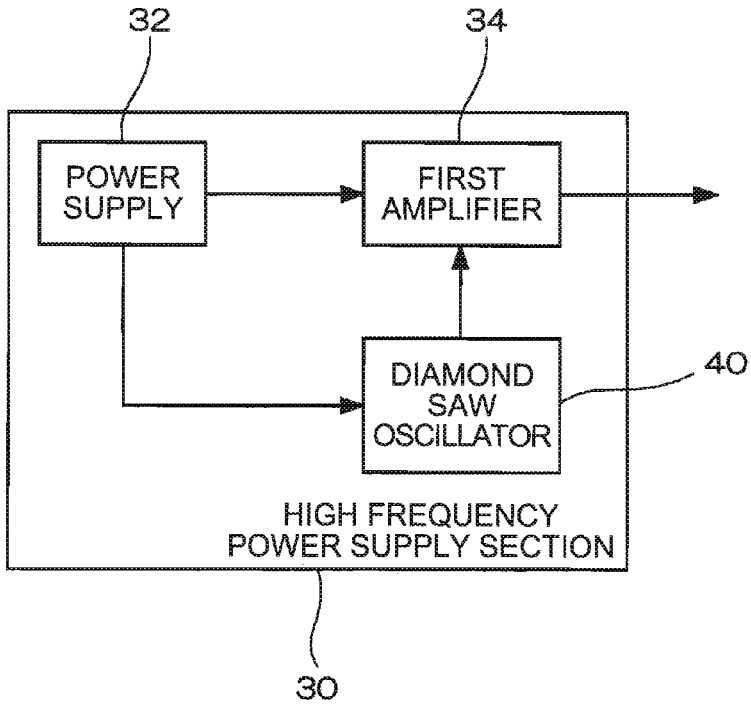
FIG. 3 is a block diagram showing a high frequency power supply section.

Further, a concrete description of the high frequency power supply section 30 will be given below. FIG. 3 is a block diagram showing a high frequency power supply section. The high frequency power supply section 30 is provided with the diamond SAW oscillator 40, a first amplifier 34 and a power supply 32. Tie power supply 32 supplies power to the diamond SAW oscillator 40 and the first amplifier 34. Further, a subsequent stage of the diamond SAW oscillator 40 is connected to a prior stage of the first amplifier 34. And the high frequency signals being output from the diamond SAW oscillator 40 are output from the high frequency power supply section 30, after being input and amplified in the first amplifier 34.

Figure 4:
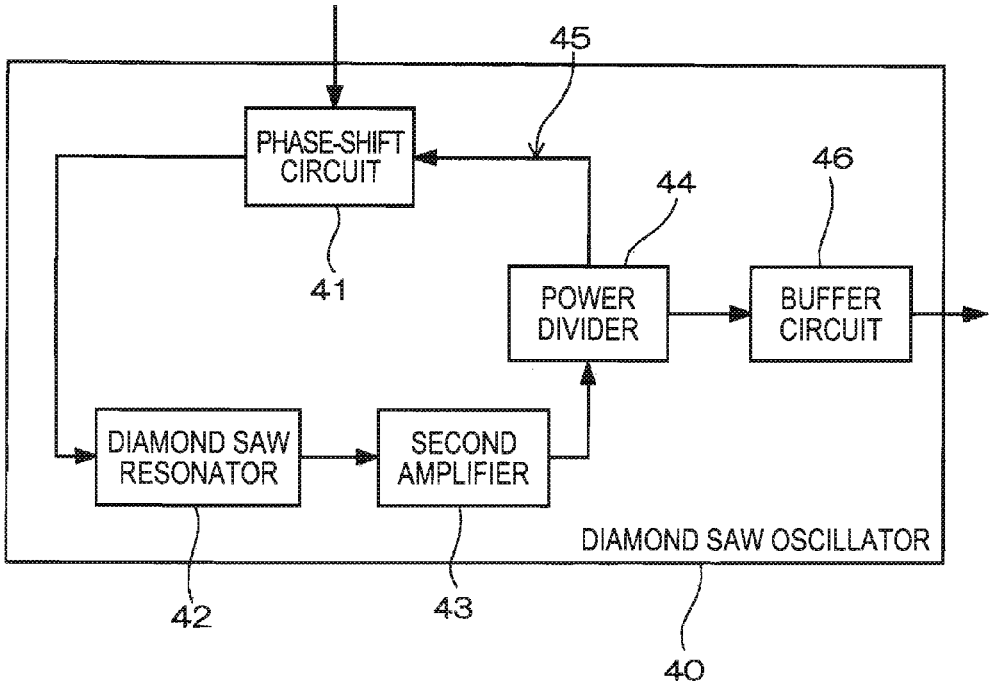
FIG. 4 is a block diagram showing a diamond SAW oscillator.

And a detailed description of the diamond SAW oscillator 40 will be given below. FIG. 4 is a block diagram showing a diamond SAW oscillator. The diamond SAW oscillator 40 is configured in a loop circuit 45 provided with a phase-shift circuit 41, a diamond SAW resonator 42, a second amplifier 43 and a power divider 44, with which a buffer circuit 46 is connected to one side of a subsequent stage (output side) of the power divider 44. The phase-shift circuit 41 changes a phase of the loop circuit 45 by supplying power from the power supply 32, in other words, by inputting control voltage from outside. The diamond SAW resonator 42 is connected to a subsequent stage of the phase-shift circuit 41. By exciting a SAW with a predetermined frequency on a substrate 52 which will hereinafter be described, the SAW resonator 42 outputs the high frequency signals corresponding to the frequency of the SAW.

The second amplifier 43 is connected to the subsequent stage of the diamond SAW resonator 42. The second amplifier 43 amplifies the high frequency signals being output from the diamond SAW resonator 42. The power divider 44 is connected to the subsequent stage of the second amplifier 43. The power divider 44 distributes the input high frequency signals to the phase-shift circuit 41 and the buffer circuit 46 which are connected to a subsequent stage. And the power divider 44 may be the one which is capable of distributing power, for example, a Wilkinson Divider and the like.

Figure 5:
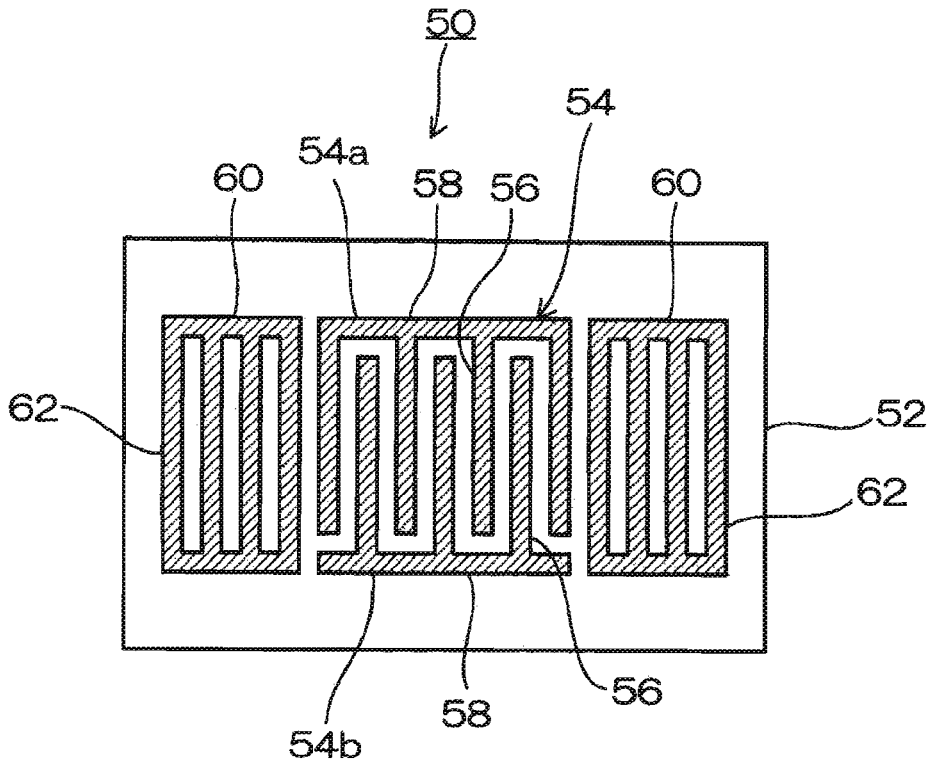
FIG. 5 is a schematic plan view showing a diamond SAW resonator element.

A detailed description of the diamond SAW resonator 42 will be given below. FIG. 5 is a schematic plan view showing a diamond SAW resonator element. The diamond SAW resonator 42 is provided with a diamond SAW resonator element 50 which is shown in FIG. 5. The diamond SAW resonator element 50 uses diamond as a substrate (piezoelectric substrate) 52. The substrate 52 with diamond may be the one diamond wafers are being cut out, the one a piezoelectric layer is provided on diamond and diamond-like carbon, the one a semiconducting diamond layer and the piezoelectric layer are provided on diamond and diamond-like carbon, and the like. Further, a piezoelectric material used for the piezoelectric layer may be zinc oxide, aluminum nitride and the like, and may be formed by a film growth method such as a vapor phase epitaxial method. The substrate 52 with diamond has good frequency-temperature characteristics and capable of outputting high frequency signals (for example, 2.4 GHz band), as a propagation speed of the SAW is fast.

And the diamond SAW resonator element is arranged with at least an IDT (inter digital transducer) 54 on the substrate 52 with diamond such as these. Further, FIG. 5 shows a configuration that the IDT 54 and a reflector 60 are being arranged on the substrate 52. The IDT 54 has a comb teeth shape 58 formed by connecting base portions of a plurality of electrode fingers 56, and is formed by interdigitating the electrode fingers 56 of the two comb teeth shapes 58 with each other And one comb teeth shape 58 becomes an input IDT 54*a* and the other comb teeth shape 58 becomes an output IDT 54*b*. Also, the reflector 60 is arranged at a position sandwiching the IDT 54. Each reflector 60 has a plurality of conductor strips 62 along the direction that the electrode fingers 56 of the IDT 54 are arranged, and formed by connecting both ends of the conductor strips 62.

When electric signals are being input, the diamond SAW resonator 42 provided with the diamond SAW resonator element 50 such as this inputs these to the input IDT 54*a*, excites the SAW directly on the substrate 52, and traps the SAW between the reflectors 60. As the SAW multiple-reflects at the reflector 60, standing waves generate between the reflectors 60. And when the SAW reaches the output IDT 54*b*, the SAW resonator 42 converts and outputs the frequency of electric signals (high frequency signals) corresponding to the frequency of the SAW.

Figure 6:
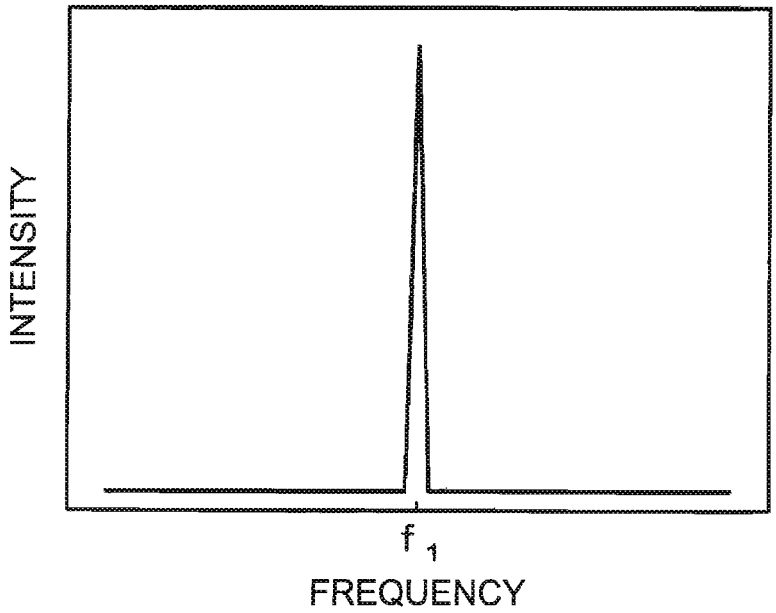
FIG. 6 is a diagram showing a relationship between the frequency and intensity of signals being output from a diamond SAW oscillator.

In this way, the diamond SAW resonator 42 is able to output signals with a certain frequency $f_1$ (high frequency signals), and do not output frequency signals other than the certain frequency $f_1$. Further, when electronic signals are being input, the diamond SAW resonator 42 outputs the high frequency signals corresponding to the SAW excited to the substrate 52 directly. FIG. 6 is a diagram showing a relationship between the frequency and intensity of signals being output from a diamond SAW oscillator. In FIG. 6, a lateral axis shows frequency and a longitudinal axis shows intensity. As shown in FIG. 6, the signals being output from the diamond SAW oscillator 40 are only high frequency signals with a certain frequency $f_1$.

Furthermore, the diamond SAW resonator element 50 may be obtained in numbers from a piece of wafer with diamond. A schematic process of manufacturing the diamond SAW resonator element 50 is as follow. First, a metal film is to be formed on a wafer. After applying a resist on the metal film, a photomask corresponding to an electrode pattern such as the IDT 54 and the reflector 60 is to be disposed. Development is to be performed after irradiating ultraviolet light to the resist through the photomask, and forms a resist film corresponding to the electrode pattern. And by etching the metal film, a plurality of the electrode patterns are to be formed on the wafer. After this, the wafer is being cut, and made into chips of the respective diamond SAW resonator elements 50. Meanwhile, on a surface of the electrode pattern, an insulating film may be formed by anodizing and the like. In this way, as a microfabrication technique is used to manufacture the diamond SAW resonator element 50, the electrode pattern can be formed with high accuracy. Therefore, by using the microfabrication technique, the diamond SAW resonator element 50 can be manufactured so that variation of resonance frequency in the wafer may be minimized. Also, it can be manufactured so that the variation of resonance frequency with respect to each wafer may be minimized.

The light-emitting device 10 such as this can emit light, as it seals a gas within the emitter 12 and excites the gas and the like by microwaves.

Also, the diamond SAW resonator 42 may be formed in a very small size. Therefore, the diamond SAW oscillator 40 may be configured so that the diamond SAW resonator 42, the phase-shift circuit 41, the second amplifier 43, the power divider 44 and the buffer circuit 46 are mounted on one package. This enables to reduce the size and weight of the high frequency power supply section 30 provided with the diamond SAW oscillator 40, and also enables to reduce the size and weight of the light-emitting device 10.

Moreover, when the high frequency power supply 32 is being operated, the diamond SAW resonator 42 outputs high frequency signals directly. As these are being output from the diamond SAW oscillator 40, and the waveguide unit 20 emits microwaves, the time between the activation and the output of microwaves can be shortened. As the light-emitting device 10 emits microwaves as soon as it activates, and emits light by excitation of the gas and the like in the emitter 12 by the microwaves, the time between the activation and the light emission of the light-emitting device 10 becomes extremely short. Therefore, when the light-emitting device 10 is used as an illumination device and the like, the power consumption of the light-emitting device 10 can be reduced by repeating an intermittent operation of the emitter 12 in an extremely short period of time, because it looks as though the emitter 12 is outputting light continuously. Further, even if the intermittent operation is performed in an extremely short period of time, because light is to be output followed by this operation, the light-emitting device 10 can control the output of the light emission. Therefore, the light-emitting device 10 may be used for optical communication devices.

Further, as the diamond SAW oscillator 40 can output high frequency signals at about several tens mA, the high frequency power supply section 30 can be reduced in power.

Furthermore, as the diamond SAW oscillator 40 is provided in the high frequency power supply section 30, it can reliably output signals only with a certain frequency (high frequency signals). Therefore, as microwaves with the frequency corresponding to the high frequency signals (predetermined frequency) are emitted from the waveguide unit 20, the gas sealed in the emitter 12 can reliably emit light by excitation and the like. And problems such as unable to excite the gas and the like sealed in the emitter 12 because of the waveguide unit 20 outputting the microwaves with different frequencies do not occur, and also do not damage (harm) devices.

Furthermore, as the light-emitting device 10 emits the microwaves from the waveguide unit 20 with frequency corresponding to the high frequency signals being output from the diamond SAW oscillator 40, unwanted radiation may be eliminated. Also, as the substrate 52 used for the diamond SAW resonator element 50 has good frequency-temperature characteristics, the frequency-temperature characteristics of the light-emitting device 10 improves and also enhance its frequency stability. And as the diamond SAW resonator element 50 uses the substrate 52 with diamond, the high frequency signals have low phase noise. Therefore, the light obtained at the emitter 12 is flicker-free.

Also, in the light-emitting device 10, there will be no variation of resonance frequency with respect to each diamond SAW resonator element 50, in other words, with respect to each diamond SAW resonator 42. So the variations do not occur to the high frequency signals being output from a high frequency oscillation section with respect to each light-emitting device 10, and the variations do not occur to the frequency of microwaves being emitted from the waveguide unit 20.

Further, as the emitter 12 used in the light-emitting device 10 outputs light by excitation of the gas and the like sealed inside, a filament and the like is not necessary inside. Therefore, the light-emitting device 10 does not need to change the emitter 12 because of the filament burn-out and the like, so that the same emitter 12 can be used for a long period of time.

Next, a second embodiment will be described. In the second embodiment, various modifications of the emitter which was explained in the first embodiment will be described. Further, in the second embodiment, description of similar component parts as those of the first embodiment will be omitted and the same numerals are to be denoted. FIGS. 7A through 7E are diagrams showing modifications of an emitter.

Figure 7A:
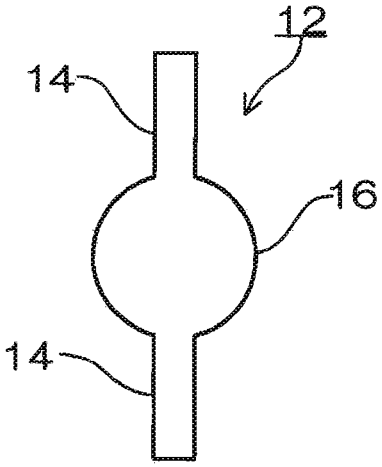
FIGS. 7A through 7E are diagrams showing modifications of an emitter.

An emitter 12 shown in FIG. 7A has an optical output section 16 in a spherical shape, and an introduction portions 14 of microwaves in a tubular shape are connected to the top and bottom of the optical output section 16. This enables the emitter 12 to excite a gas sealed inside and the like by introducing microwaves to a plurality of places.

Figure 7D:
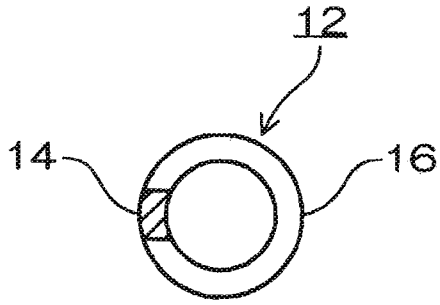
Figure 7B:
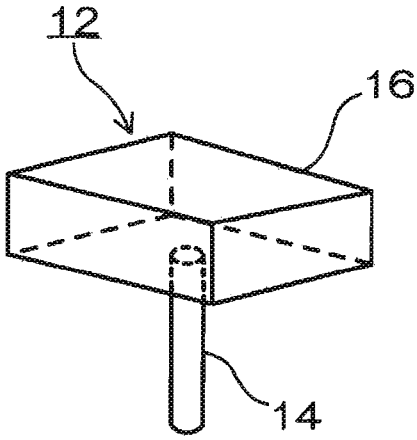

Further, the emitter 12 shown in FIG. 7B has the optical output section 16 in a rectangular parallelepiped, and the introduction portion 14 of microwaves in a tubular shape is connected to the bottom side of the optical output section 16. This enables the emitter 12 to emit light from the rectangular parallelepiped by excitation of the gas and the like, sealed inside by microwaves being input to the introduction portion 14. As the optical output section 16 is formed in the rectangular parallelepiped, the emitter 12 is capable of surface emission.

Figure 7E:
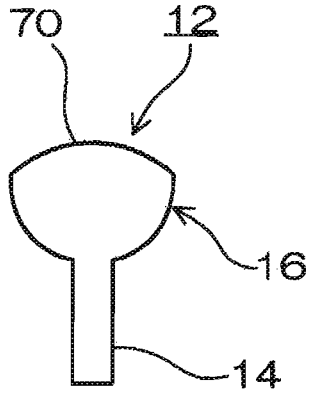
Figure 7C:
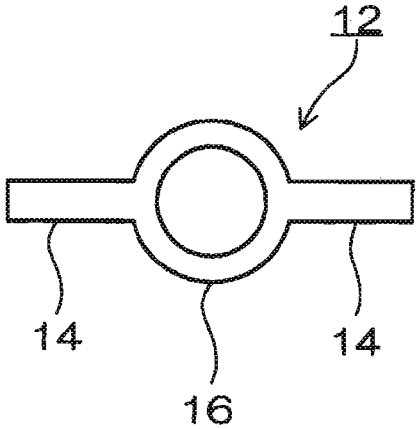

Furthermore, the emitter 12 shown in FIG. 7C has the optical output section 16 in a ring-shape, and the introduction portions 14 of microwaves in a tubular shape are connected to both sides of the optical output section 16. This enables the optical output section 16 in a ring-shape to output light.

Also, the emitter 12 shown in FIG. 7D is in a ring-shape, and it has a structure that a part of the ring-shape is the introduction portion 14. And in FIG. 7D, a part indicated by dashed lines is the introduction portion 14. This enables the microwaves being input to the introduction portion 14, and outputs light from the optical output section 16 provided in succession with the introduction portion 14.

Also, the emitter 12 shown in FIG. 7E has the optical output section 16 formed with a lens 70, and the introduction portion 14 of microwaves in a tubular shape is connected to the bottom side of the optical output section 16. This enables the microwaves being input to the introduction portion 14 to excite the gas and the like sealed inside, and outputs light through the lens 70 of the optical output section 16. And the lens 70, for example, may be a spherical lens, an aspherical lens, a cylindrical lens, a toroidal lens, a Fresnel lens and the like.

Further, the optical output section 16 of the emitter 12, although not shown, may have a shape of one of a cube, a straight pipe and a hemispherical shape. In such a case, the introduction portion 14 of microwaves is connected to the optical output section 16. And the introduction portion 14 may not be limited to a tubular shape.

Next, a third embodiment will be described. In the third embodiment, a modification of the diamond SAW oscillator explained in the first embodiment is to be described. Further, in the third embodiment, description of similar component parts as those of the first embodiment will be omitted and the same numerals are to be denoted.

Figure 8:
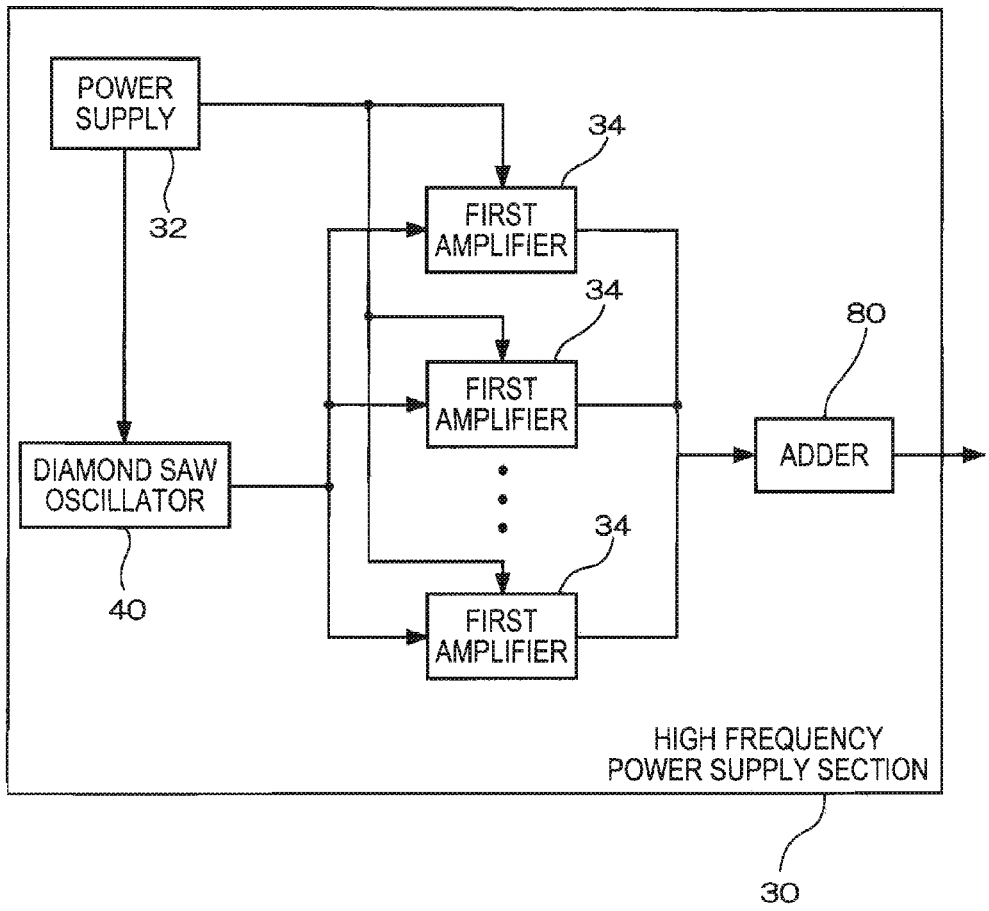
FIG. 8 is a block diagram showing a high frequency power supply section according to a third embodiment.
Figure 9:
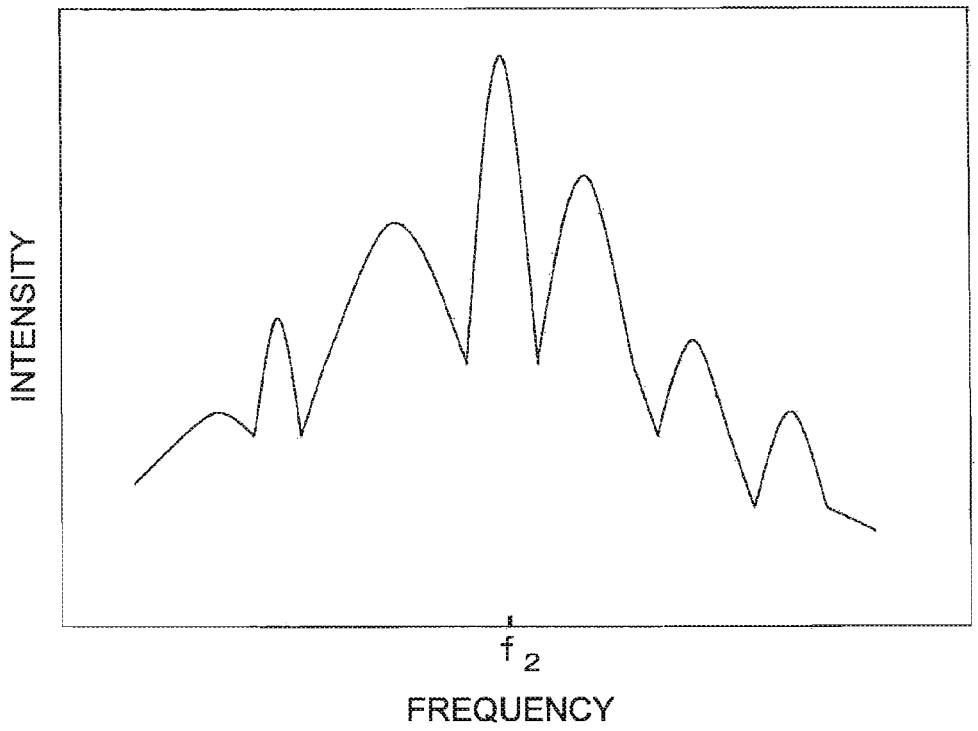
FIG. 9 is a diagram showing a relationship between the frequency and intensity of signals being output from a magnetron.

FIG. 8 is a block diagram showing a high frequency power supply section according to the third embodiment. A high frequency power supply section 30 has a structure provided with a diamond SAW oscillator 40, a plurality of first amplifiers 34, an adder 80 and a power supply 32. The power supply 32 supplies power to the diamond SAW oscillator 40 and each of the first amplifier 34. Further, the plurality of first amplifiers 34 are connected in parallel between the diamond SAW oscillator 40 and an adder 80. And the high frequency signals being output from the diamond SAW oscillator 40 are being input to each of the first amplifier 34. The first amplifier 34 amplifies the high frequency signals being input from the diamond SAW oscillator 40, and outputs to the adder 80. The adder 80 adds the high frequency signals being input from each of the first amplifier 34, and outputs the added high frequency signals. The high frequency signals being output from the adder 80 become the high frequency signals being output from the high frequency power supply section 30.

The high frequency power supply section 30 such as this amplifies the high frequency signals being input from the diamond SAW oscillator 40 at each of the first amplifier 34, and combines them in the adder 80, enabling to output the high frequency signals in high power.

The entire disclosure of Japanese Patent Application No. 2005-282112, filed Sep. 28, 2005 is expressly incorporated by reference herein.

What is claimed is:

1. A light-emitting device, comprising:

an emitter sealed with a gas that emits light caused by a microwave;

a high frequency power supply section including a diamond SAW oscillator and outputting a high frequency signal being outputted from the diamond SAW oscillator to a subsequent stage, the SAW oscillator having a diamond SAW resonator arranged with at least an inter digital transducer on a substrate with a diamond; and a waveguide unit emitting the high frequency signal being inputted from the high frequency power supply section towards the emitter as the microwave.

2. The light-emitting device according to claim 1, the emitter including an introduction portion of the microwave and an optical output section to output light emission of the gas to outside.

3. The light-emitting device according to claim 2, the optical output section including a lens.

4. The light-emitting device according to claim 2, the optical output section having a shape of one of a spherical shape, a rectangular parallelepiped, a cube, a ring-shape, a straight pipe and a hemispherical shape.

5. The light-emitting device according to claim 1, the high frequency power supply section including:

the diamond SAW oscillator that outputs the high frequency signal;

a first amplifier that amplifies and outputs the high frequency signal being received from the diamond SAW oscillator; and a power supply that supplies power to the diamond SAW oscillator and the first amplifier.

6. The light-emitting device according to claim 5, the diamond SAW oscillator forms a loop circuit that including:

a phase-shift circuit that receives power from the power supply;

a diamond SAW resonator arranged with at least the inter digital transducer on the substrate with diamond;

a second amplifier that amplifies the high frequency signal being outputted from the diamond SAW resonator; and a power divider that distributes the high frequency signal being outputted from the second amplifier to the phase-shift circuit and an output side.

7. The light-emitting device according to claim 1, the high frequency power supply section including:

the diamond SAW oscillator that outputs the high frequency signal;

a plurality of first amplifiers that are connected in parallel with the diamond SAW oscillator and that receive the high frequency signal from the diamond SAW oscillator, respectively;

the power supply that supplies power to the diamond SAW oscillator and the first amplifiers; and an adder connected to a subsequent stage of the first amplifier, the adder receiving and adding the high frequency signal being outputted from each of the first amplifier, and outputting the added high frequency signal.

* * * * *